United States Patent [19]

Dany et al.

[11] Patent Number: 5,066,415

[45] Date of Patent: Nov. 19, 1991

[54] DISHWASHING AGENT

[75] Inventors: Franz-Josef Dany; Hannsjörg Ulrich, both of Erftstadt; Lothar Westermann, Cologne, Fed. Rep. of Germany

[73] Assignee: Hoechst Aktiengesellschaft, Frankfurt am Main, Fed. Rep. of Germany

[21] Appl. No.: 572,883

[22] Filed: Aug. 24, 1990

[30] Foreign Application Priority Data

Sep. 8, 1989 [DE] Fed. Rep. of Germany ..... 3929896

[51] Int. Cl.[5] ..... C11D 7/02

[52] U.S. Cl. ..... 252/135; 252/156; 252/173; 252/DIG. 14; 252/99; 252/174.21; 252/174; 252/174.15; 252/89.1; 252/174.25

[58] Field of Search ..... 252/99, 174.21, 174, 252/174.15, 89.1, 135, 156, 173, DIG. 14, 174.25

[56] References Cited

U.S. PATENT DOCUMENTS 3,763,047 10/1973 Fairs ..... 252/174.21
3,899,436 8/1975 Copeland et al. .
4,587,031 6/1986 Kruse ..... 252/99

FOREIGN PATENT DOCUMENTS 2062465 6/1972 Fed. Rep. of Germany .
3627773 2/1988 Fed. Rep. of Germany .

OTHER PUBLICATIONS

"Methods for Measuring the Performance of Electric Dishwashers", Int'l Electrotechnical Comm. Standard, Publication 436 (1981).

*Primary Examiner*—Paul Lieberman
*Assistant Examiner*—Kevin D. McCarthy
*Attorney, Agent, or Firm*—Connolly & Hutz

[57] ABSTRACT

A dishwashing agent consists of a crystalline, largely water-insoluble sodium layer silicate having a molar ratio of $SiO_2/Na_2O$ of (1.9 to 3.5):1 in combination with a proton donor, a 0.5% strength by weight aqueous solution of the dishwashing agent having a pH of less than 10. The dishwashing agent can furthermore contain a surfactant, an active chlorine or active oxygen carrier, a dispersing agent, an alkali metal phosphate or an alkali metal polyphosphate and a filler.

4 Claims, No Drawings

DISHWASHING AGENT

The present invention relates to a dishwashing agent based on a crystalline alkali metal layer silicate.

Cleaning agent mixtures which contain sodium tripolyphosphate as builders, sodium metasilicate as alkali carriers, chloroisocyanurates as active chlorine carriers or alkali metal perborates, persulfates and percarbonates as active oxygen carriers, and low-foaming block polymers having ethylene oxide and propylene oxide groups or modified fatty alcohol polyglycol ethers as surfactants are known as agents for mechanical washing of dishes. The cleaning agent mixtures can furthermore contain alkali metal citrates or aminopolycarboxylic acids. The pH of the cleaning agent mixtures in a concentration of 1% by weight is at least 10 and occasionally up to 12 (compare DE-OS 2 142 055 and DE-AS 2 062 465).

The phosphate-free dishwashing agent according to DE-OS 3 627 773 contains a crystalline alkali metal layer silicate together with a co-builder, for example acrylic acid polymers, polycarboxylates, maleic acid copolymers or vinyl ether carboxylates, in addition to an alkali carrier, a surfactant and an active chlorine carrier, sodium metasilicate, sodium carbonate or sodium hydroxide being used as the alkali carrier.

A disadvantage of the known agents is that they only display their full cleaning action if their content of alkali carrier is so high that the pH in the cleaning liquor is at least 11, which is hazardous in view of the caustic action on the skin and eyes.

The object of the present invention is thus to provide a dishwashing agent which has the lowest possible pH in its cleaning liquor coupled with a good cleaning power. According to the invention, this is achieved by a dishwashing agent which contains a crystalline, largely water-insoluble sodium layer silicate having a molar ratio of $SiO_2/Na_2O$ of (1.9 to 3.5):1 in combination with a proton donor, and which has a pH of less than 10 in a 0.5% strength by weight aqueous solution.

The dishwashing agent according to the invention can contain 20 to 60% by weight of the crystalline layer silicate
10 to 40% by weight of the proton donor
1 to 2% by weight of a surfactant
1 to 30% by weight of an active chlorine carrier or active oxygen carrier
0 to 7% by weight of a dispersing agent
0 to 50% by weight of an alkali metal phosphate and/or an alkali metal polyphosphate and
0 to 40% by weight of a filler.

The dishwashing agent according to the invention can furthermore also be designed, if appropriate, so that a) it contains mineral acids and/or polycarboxylic acids and/or hydroxypolycarboxylic acids and/or phosphonic acids and/or acid salts or esters thereof as the proton donor;
b) it contains 25 to 35% by weight of crystalline alkali metal layer silicate; and
c) it contains 10 to 30% by weight of alkali metal phosphate and/or alkali metal polyphosphate.

Suitable proton donors in the dishwashing agent according to the invention are polycarboxylic acids, such as fumaric, adipic and glutaric acid, hydroxypolycarboxylic acids, such as citric acid and tartaric acid, and phosphonic acids, such as 1-hydroxyethane-1,1-diphosphonic acid, 2-phosphono-butane-1,2,4-tricarboxylic acid, aminotri-(methylenephosphonic acid), ethylenediaminetetra(methylenephosphonic acid), 3-tert.alkyl-3-oxo-1-aminopropane-1,1-diphosphonic acid, 3-tert.alkyl-3-oxo-1-hydroxypropane-1,1-diphosphonic acid and ω-dimethylaminoalkane-1-hydroxy-1,1-diphosphonic acids. Instead of the acids, it is also possible to employ water-soluble acid salts thereof. Mineral acids and acid salts and esters thereof, such as monosodium dihydrogen monophosphate, monopotassium dihydrogen monophosphate, disodium dihydrogen diphosphate, acid esters of phosphoric acid, sodium bisulfate and sodium bicarbonate, can furthermore be used as proton donors.

The dishwashing agent according to the invention can contain sodium sulfate as the filler, sodium triphosphate as the builder, polymeric or copolymeric polycarboxylic acids or water-soluble salts thereof as dispersing agents, block polymers of long-chain aliphatic alcohols having ethylene oxide or propylene oxide groups or modified fatty alcohol polyglycol ethers as surfactants and sodium dichloroisocyanurate as the active chlorine carrier or alkali metal perborate, persulfate or percarbonate as well as peroxycarboxylic acids and salts thereof, such as dodecaneperoxydicarboxylic acid or magnesium peroxyphthalate as active oxygen carriers.

The dishwashing agent according to the invention is distinguished by a good cleaning power even on critical dirt, such as burnt-on protein-containing food residues. It moreover has a high stability to chlorine or active oxygen and causes relatively little corrosion on sensitive items to be washed.

The dishwashing agent according to the invention is preferably employed in domestic dishwashers, but can also be used in commercial dishwashing machines.

The concentration of pulverulent dishwashing agent according to the invention in the cleaning liquor is 3 to 10 g/l preferably 4 to 5 g/l.

The pH which can be achieved by the dishwashing agent according to the invention in its cleaning liquor primarily depends on the concentration ratio of sodium layer silicate to proton donor. It would thus be obvious to combine free layer silicic acid with alkalis in order to obtain the same pH in the cleaning liquor. However, it has been found that in spite of the same pH in the cleaning liquor when layer silicic acid/alkalis are combined, the cleaning result such as that with the dishwashing agent according to the invention cannot be achieved.

The pH of aqueous solutions of dishwashing agents was determined as follows:

10 g of the dishwashing agent were weighed into a 100 ml measuring flask, 80 ml of demineralized water were added and the mixture was stirred vigorously, but avoiding foaming, at room temperature for 1 hour using a magnetic stirrer. When the magnetic stirrer had been removed, the measuring flask was made up to the mark with demineralized water and the solution was mixed thoroughly and centrifuged immediately. The pH measurements were made immediately thereafter using a glass electrode.

After the solid had been centrifuged off, the pH of the cleaning liquor was also determined immediately thereafter with the aid of a glass electrode.

The following mixtures A to M were prepared and tested in order to demonstrate the advantageous properties of the dishwashing agent according to the invention, mixtures A to D corresponding to dishwashing agents according to the prior art, whereas mixtures E to M are dishwashing agents according to the invention:

A 30% by weight of sodium triphosphate, partly hydrated
57% by weight of sodium metasilicate, anhydrous
10% by weight of sodium carbonate, anhydrous
2% by weight of sodium dichloroisocyanurate.$2H_2O$
1% by weight of modified fatty alcohol polyglycol ether B 50% by weight of zeolite A
40% by weight of sodium metasilicate, anhydrous
6% by weight of sodium sulfate, anhydrous
2% by weight of sodium dichloroisocyanurate $2H_2O$ C 50% by weight of crystalline sodium layer silicate
40% by weight of sodium metasilicate, anhydrous
6% by weight of sodium sulfate, anhydrous
2% by weight of sodium dichloroisocyanurate.$2H_2O$
2% by weight of modified fatty alcohol polyglycol ether D 40% by weight of crystalline sodium layer silicate
28% by weight of sodium sulfate, anhydrous
10% by weight of sodium carbonate, anhydrous
15% by weight of sodium hydroxide
2% by weight of modified fatty alcohol polyglycol ether
1% by weight of sodium dichloroisocyanurate.$2H_2O$
4% by weight of maleic anhydride/methyl vinyl ether copolymer, sodium salt (for example ®Sokalan CP 2 from BASF AG)

E 30% by weight of crystalline sodium layer silicate
33% by weight of sodium bicarbonate
30% by weight of sodium triphosphate
4% by weight of copolymer based on maleic anhydride, sodium salt (about 55% of active substance; for example ®Sokalan PM 10 from BASF AG)
2% by weight of modified fatty alcohol polyglycol ether
1% by weight of sodium dichloroisocyanurate.$2H_2O$ F 30% by weight of crystalline sodium layer silicate
20% by weight of disodium dihydrogen diphosphate
10% by weight of sodium triphosphate
4% by weight of modified polyacrylic acid (molecular weight = 20,000, 35% of active substance; for example ®Sokalan CP 13 S from BASF AG)
2% by weight of modified fatty alcohol polyglycol ether
1% by weight of sodium dichloroisocyanurate.$2H_2O$
33% by weight of sodium sulfate, anhydrous G 30% by weight of crystalline sodium layer silicate
16% by weight of butyl/ethylene glycol-phosphoric acid ester (for example Knapsack cleansing component GB from HOECHST AG)
15% by weight of sodium triphosphate
4% by weight of modified polyacrylic acid, sodium salt (molecular weight = 70,000, 40% of active substance; for example ®Sokalan CP 5 from BASF AG)
2% by weight of modified fatty alcohol polyglycol ether
1% by weight of sodium dichloroisocyanurate.$2H_2O$
32% by weight of sodium sulfate, anhydrous H 60% by weight of crystalline sodium layer silicate
35% by weight of sodium bicarbonate
2% by weight of modified fatty alcohol polyglycol ether
3% by weight of sodium dichloroisocyanurate.$2H_2O$ 40% by weight of crystalline sodium layer silicate
27% by weight of sodium bisulfate
20% by weight of sodium triphosphate
1% by weight of modified fatty alcohol polyglycol ether
12% by weight of sodium percarbonate J 40% by weight of crystalline sodium layer silicate
26% by weight of 2-phosphono-butane-1,2,4-tricarboxylic acid (50% of active substance; for example ®Bayhibit AM from Bayer AG)
31% by weight of sodium sulfate, anhydrous
2% by weight of modified fatty alcohol polyglycol ether
1% weight of sodium dichloroisocyanurate.$2H_2O$ K 30% by weight of crystalline sodium layer silicate
30% by weight of sodium triphosphate
14% by weight of citric acid monohydrate
2% by weight of modified fatty alcohol polyglycol ether
1% by weight of sodium dichloroisocyanurate.$2H_2O$
23% by weight of sodium sulfate, anhydrous L 40% by weight of crystalline sodium layer silicate
14% by weight of 85% strength phosphoric acid
40% by weight of sodium sulfate, anhydrous
2% by weight of modified polyacrylic acid (sodium salt; for example ®Sokalan CP 10 from BASF AG)
2% by weight of sodium dichloroisocyanurate.$2H_2O$
2% by weight of modified fatty alcohol polyglycol ether M 30% by weight of crystalline sodium layer silicate
30% by weight of sodium triphosphate
14% by weight of a mixture of not more than 33% of adipic, nor more than 50% of glutaric and not more than 31% of succinic acid (®Sokalan DCS from BASF AG)
2% by weight of modified fatty alcohol polyglycol ether
2% by weight of sodium dichloroisocyanurate.$2H_2O$
22% by weight of sodium sulfate.

EXAMPLE 1

Mixtures A to M were tested for their cleaning action, also using a rinsing aid, in a domestic dishwashing machine from MIELE. The results of the testing are shown in Table 1, which shows the pH of a 10% strength aqueous solution of the mixture in the first row, the pH of the cleaning liquor (5 g of mixture/1 of water) in the second row and the cleaning index in accordance with DIN 44 990, part 2 (draft, December 1980).

TABLE 1

| | Prior Art | | | | According to the invention | | | | | | | | |
|---|---|---|---|---|---|---|---|---|---|---|---|---|---|
| Mixture | A | B | C | D | E | F | G | H | I | J | K | L | M |
| pH (10 g/100 ml) | 13.1 | 13.1 | 12.3 | 13.3 | 10.4 | 10.3 | 10.2 | 10.3 | 10.4 | 10.3 | 10.1 | 10.4 | 10.4 |
| pH (5 g/l) | 12.2 | 11.9 | 11.2 | 11.9 | 9.9 | 9.6 | 9.6 | 9.9 | 9.5 | 9.4 | 9.7 | 9.9 | 9.8 |
| Cleaning index | 4.2 | 4.0 | 4.4 | 4.4 | 4.3 | 4.0 | 3.9 | 4.3 | 4.4 | 4.2 | 3.8 | 4.0 | 4.0 |

A comparison of the cleaning indices shows that the dishwashing agents according to the invention have cleaning results comparable to those of formulations according to the prior art, in spite of a considerable reduction of the pH in the washing liquors.

EXAMPLE 2

The corrosive damage was tested on stainless steel cutlery and glasses of various origin, composition and shape. Porcelain plates and cups were used as ballast for making up the prescribed quantity of items to be washed of 12 standard place settings in accordance with DIN 44 990, part 100 (draft, December 1981).

The damage was evaluated by a scale divided into 5 stages, according to which visual evaluation of the experiments was made after 125, 250, 500 and 1,000 washing operations. This scale enabled intermediate levels in units of 0.5 to be specified (0=undamaged; 4 —total damage).

Mixtures A and B according to the prior art and dishwashing agents E, F, H and K according to the invention were used for the corrosion testing. The average damage evaluations determined after 1,000 washing operations are summarized in Table 2. An automatically operating domestic dishwashing machine which opens the machine door for 30 minutes after each washing cycle, allowing the items washed to cool, was used. 5 g of mixture/l of washing liquor were metered in for the cleaning cycle and 3 ml of commercially available rinsing aid were metered in for the rinsing cycle. Non-soiled items to be washed were employed.

TABLE 2

| | Prior Art | | According to the invention | | | |
|---|---|---|---|---|---|---|
| Mixture | A | B | E | F | H | K |
| Glass | 0.6 | 1.8 | 0.6 | 0.8 | 0.5 | 0.7 |
| Cutlery | 1.5 | 0.7 | 0.4 | 0.1 | 0.0 | 0.5 |
| Total | 2.1 | 2.5 | 1.0 | 0.9 | 0.5 | 1.2 |

EXAMPLE 3

Mixtures A and B according to the prior art and dishwashing agents E, F, H, I and K according to the invention were kept open in the atmosphere in the laboratory for 3 months. The loss of active chlorine or active oxygen in comparison with the content immediately after preparation of the mixtures was then determined. The percentage decrease is shown in Table 3.

TABLE 3

| | Prior art | | According to the invention | | | | |
|---|---|---|---|---|---|---|---|
| Mixture | A | B | E | F | H | I | K |
| Loss of active chlorine in % | 39.0 | 41.5 | 15.1 | 9.5 | 19.0 | — | 12.1 |
| Loss of active oxygen in % | — | — | — | — | — | 19.5 | — |

This shows that the storage stability of the dishwashing agents according to the invention in respect of active chlorine or active oxygen is greater than that of the corresponding mixtures according to the prior art.

We claim:

1. A dishwashing agent based on a crystalline alkali metal layer silicate comprising a crystalline, largely water-insoluble sodium layer silicate having a molar ratio of $SiO_2/Na_2O$ of (1.9 to 3.5):1 and a proton donor selected from the group consisting of mineral acids, polycarboxylic acids, hydroxypolycarboxylic acids, phosphonic acids, acid salts thereof and acid esters thereof, and wherein a 0.5% strength by weight aqueous solution of said dishwashing agent has a pH-value of less than 10.

2. The dishwashing agent as claimed in claim 1, containing 20 to 60% by weight of the crystalline layer silicate
10 to 40% by weight of the proton donor
1 to 2% by weight of a surfactant
1 to 30% by weight of an active chlorine carrier or an active oxygen carrier
0 to 7% by weight of a dispersing agent
0 to 50% by weight of at least one substance selected from the group comprising alkali metal phosphates and alkali metal polyphosphates and
0 to 40% by weight of a filler.

3. The dishwashing agent according to claim 2, containing 25 to 35% by weight of crystalline alkali metal layer silicate.

4. The dishwashing agent as claimed in claim 2, containing 10 to 30% by weight of at least one substance selected from alkali metal phosphates and alkali metal polyphosphates.

* * * * *